US005269973A

United States Patent [19]

Takahashi et al.

[11] Patent Number: 5,269,973

[45] Date of Patent: Dec. 14, 1993

[54] ELECTRICALLY CONDUCTIVE MATERIAL

[75] Inventors: Kiyofumi Takahashi, Yahata, Naokazu Takada; Shinji Tomibe, both of Kyoto, all of Japan

[73] Assignee: Nihon Sanmo Dyeing Co., Ltd., Japan

[21] Appl. No.: 744,398

[22] Filed: Aug. 13, 1991

[30] Foreign Application Priority Data

Mar. 13, 1991 [JP] Japan ..... 3-74141

[51] Int. Cl.[5] ..... H01B 1/06

[52] U.S. Cl. ..... 252/521; 252/518; 427/419.1; 427/419.7; 428/389

[58] Field of Search ..... 252/500, 506, 508, 509, 252/510, 518, 521; 427/400, 412.4, 419.1, 419.7; 428/195, 209, 379, 463, 389; 429/191

[56] References Cited

U.S. PATENT DOCUMENTS

| | | | |
|---|---|---|---|
| 3,940,533 | 2/1976 | Arsac | 428/225 |
| 3,958,066 | 5/1976 | Imamura et al. | 428/372 |
| 3,983,286 | 9/1976 | Arsac | 428/225 |
| 4,378,226 | 3/1983 | Tomibe et al. | 8/491 |
| 4,556,508 | 12/1985 | Tomibe et al. | 252/518 |
| 4,690,854 | 9/1987 | Tomibe et al. | 478/195 |
| 4,795,660 | 1/1989 | Cooray et al. | 427/123 |
| 4,824,871 | 4/1089 | Shinomura | 521/53 |

FOREIGN PATENT DOCUMENTS

| | | |
|---|---|---|
| 0086072 | 8/1983 | European Pat. Off. . |
| 0217987 | 8/1983 | European Pat. Off. . |
| 0160406 | 11/1985 | European Pat. Off. . |
| 0308234 | 3/1989 | European Pat. Off. . |
| 0336304 | 10/1989 | European Pat. Off. . |

*Primary Examiner*—Karl Group
*Assistant Examiner*—Michael A. Marcheschi
*Attorney, Agent, or Firm*—Lorusso & Loud

[57] ABSTRACT

An electrically conductive material includes a polymeric substrate containing a group which can capture cuprous ion, a first sulfide consisting of copper sulfide, a second sulfide selected from silver sulfide and palladium sulfide, and a third sulfide selected from sulfides of Bi, Zn, In, V, Si, Sb, Al, Mn, Rb, Li, Tl, W, Ti, Cr, Mo, Y, Ge, Yb, La, Sm, Be, Sn, Zr, Mg, Ba, Nd, Cd and Ga, wherein the first, second and third sulfides are bound to the polymeric substrate. This material may be produced by treating the substrate with an aqeuous bath containing sources of the first, second and third metals and thiocyanate.

6 Claims, No Drawings

ELECTRICALLY CONDUCTIVE MATERIAL

BACKGROUND OF THE INVENTION

1. Field of the Invention

This invention relates to a copper sulfide-carrying, electrically conducting material and to a process for the preparation thereof.

2. The Prior Art

U.S. Pat. No. 4,556,508 and U.S. Pat. No. 4,690,854 disclose electrically conducting materials which include a polymeric substrate containing a functional group such as a cyano group or a mercapto group, and copper sulfide bound to the substrate. These patents also suggest incorporation of a small amount of silver sulfide or palladium sulfide to improve stability of the conducting material such as resistance to washing. These electrically conducting materials are now put into practice and have enjoyed commercial success.

However, the conducting materials still lose their conductivity during repeated use for a long period of time. The present invention has been made to improve the stability of copper sulfide-carrying, electrically conducting, polymeric materials.

SUMMARY OF THE INVENTION

In accordance with one aspect of the present invention there is provided an electrically conductive material comprising a polymeric substrate containing a group which can capture cuprous ion, a first sulfide consisting of copper sulfide, a second sulfide which is at least one member selected from the group consisting of silver sulfide and palladium sulfide, and a third sulfide which is at least one member selected from the group consisting of sulfides of Bi, Zn, In, V, Si, Sb, Al, Mn, Rb, Li, Tl, W, Ti, Cr, Mo, Y, Ge, Yb, La, Sm, Be, Sn, Zr, Mg, Ba, Nd, Cd and Ga, said first, second and third sulfides being bound to said polymeric substrate.

In another aspect, the present invention provides a process for the preparation of an electrically conducting material, comprising treating a polymeric substrate containing a group which can capture cuprous ion with an aqueous bath containing a source of first metal ion which is copper ion, a source of a second metal ion selected from the group consisting of silver ion and palladium ion, a source of third metal ion selected from the group consisting of ions of Bi, Zn, In, V, Si, Sb, Al, Mn, Rb, Li, Tl, W, Ti, Cr, Mo, Y, Ge, Yb, La, Sm, Be, Sn, Zr, Mg, Ba, Nd, Cd and Ga, and thiosulfate to form sulfides of said first, second and third metals bound to said polymeric substrate.

The present invention also provides a process for the preparation of an electrically conducting material, comprising treating a polymeric substrate containing sulfide of a first metal which is copper sulfide bound thereto with an aqueous bath containing a source of a second metal ion selected from the group consisting of silver ion and palladium ion, a source of third metal ion selected from the group consisting of ions of Bi, Zn, In, V, Si, Sb, Al, Mn, Rb, Li, Tl, W, Ti, Cr, Mo, Y, Ge, Yb, La, Sm, Be, Sn, Zr, Mg, Ba, Nd, Cd and Ga, and thiosulfate to form sulfides of said second and third metals bound to said polymeric substrate.

DESCRIPTION OF THE PREFERRED EMBODIMENTS

The present invention will now be described in more detail below.

Any polymeric material may be used as a substrate for the formation of the electrically conducting material according to the present invention as long as the polymeric material contain a group which can absorb, bind or capture monovalent copper ion. Examples of such cuprous ion-binding group include a cyano group, a mercapto group, a thiocarbonyl group, an amino group and an isocyanato group. The polymers used as a substrate in the above-mentioned U.S. Pat. No. 4,556,508 and U.S. Pat. No. 4,690,854 may be suitably used for the purpose of the present invention. Polymers which originally have no such a cuprous ion-binding group may be used after the treatment of the polymers to incorporate the group.

Thus, (a) homopolymers or copolymers of a monomer containing a cuprous ion-binding group, (b) polymers to which such a monomer is grafted, (c) copolymers of (a) with other polymers, (e) blends of (a) with other polymers or copolymers, and (d) polymers with which a compound containing a cuprous ion-binding group (eg. silane coupling agent) has been reacted may be suitably used. Illustrative of suitable polymeric materials are polyacrylonitrile, acrylonitrile copolymers, polyurethane and polymers to which a cyano group, a mercapto group or an amino group has been incorporated.

When cyano, mercapto, thiocarbonyl, quaternary ammonium salt, amine or isocyanato is employed as the cuprous ion-binding group, the amount of such a group in the polymeric material is preferably at least 0.01% by weight, more preferably 0.2% by weight, when calculated as sulfur or nitrogen atom.

The polymeric substrate may be in the form of a shaped body such as fiber, fabric, thread, film, block, plate, vessel, tube or granule or in the form of powder.

To the above polymeric substrate are bound a first sulfide consisting of copper sulfide, a second sulfide which is at least one member selected from the group consisting of silver sulfide and palladium sulfide, and a third sulfide which is at least one member selected from the group consisting of sulfides of Bi, Zn, In, V, Si, Sb, Al, Mn, Rb, Li, Tl, W, Ti, Cr, Mo, Y, Ge, Yb, La, Sm, Be, Sn, Zr, Mg, Ba, Nd, Cd and Ga. It is important that these three kinds of sulfides should be present in order to obtain conducting materials with improved stability or durability.

The amount of the first sulfide is preferably 0.5–30% based on the weight of the polymeric substrate, while the amounts of the second and third sulfides are preferably such as to provide an atomic ratio $M_2/Cu$ of in the range of 0.001–1.0, more preferably 0.01–0.7, and an atomic ratio $M_3/Cu$ of in the range of 0.001–1.0, more preferably 0.01–0.7, where $M_2$ and $M_3$ represent the metals of the second and third sulfides, respectively.

The electrically conducting material may be prepared by treating a polymeric substrate containing a group which can capture cuprous ion with an aqueous bath containing a source of a first metal ion which is copper ion, a source of a second metal ion selected from the group consisting of silver ion and palladium ion, a source of third metal ion selected from the group consisting of ions of Bi, Zn, In, V, Si, Sb, Al, Mn, Rb, Li, Tl, W, Ti, Cr, Mo, Y, Ge, Yb, La, Sm, Be, Sn, Zr, Mg, Ba, Nd, Cd and Ga, and thiosulfate to form sulfides of the first, second and third metals bound to the polymeric substrate.

The thiosulfate, which may be sodium thiosulfate or potassium thiosulfate, is considered to interact with the first through third metal ions and to serve to function as a reducing agent, a sulfurizing agent and a complex-forming agent therefor.

The sources of the first through third metal ions may be salts, generally water-soluble salts, of the first through third metals, such as sulfates, basic sulfates, halogenides, organic acid salts and nitrates. Salts which are insoluble or slightly soluble in water may be used by converting such salts into water-soluble complexes using a thiosulfate or the like complex-forming agent.

More particularly, as the source of copper ion, there may be mentioned cupric sulfate, cupric chloride, cupric nitrate and cupric acetate.

As the source of silver ion, there may be mentioned silver nitrate and silver sulfate. Palladium chloride is an example of the source of palladium ion.

Illustrative of suitable third metal ion sources are as follows:

$Bi(NO_3)_3$, $Bi_2(SO_4)_3$, $(BiO)_2SO_4$;
$Zn(NO_3)_2$, $ZnSO_4$;
$InCl_3$, $In_2(SO_4)_3$;
$SiCl_4$, $SiF_4$;
$SbCl_5$, $SbCl_3$;
$Al_2O(CH_3COO)$, $AlCl_3$, $Al(NO_3)_3$, $Al_2(SO_4)_3$;
$MnCl_2$, $Mn(NO_3)_2$, $MnSO_4$;
$CH_3COORb$, $RbCl$, $Rb_2SO_4$;
$CH_3COOLi$, $LiCl$, $LiNO_3$, $Li_2SO_4$;
$TlNO_3$, $Tl_2SO_4$;
$WCl_6$, $WCl_4$;
$TiCl_4$, $TiBr_4$, $TiCl_3$;
$CrCl_3$, $Cr(NO_3)_3$, $Cr_2(SO_4)_3$;
$MoCl_5$, $MoCl_3$, $MoCl_4$;
$YCl_3$, $Y(NO_3)_3$;
$GeCl_4$, $GeF_4$;
$YbCl_3$, $Yb(NO_3)_3$;
$La(NO_3)_3$, $LaCl_3$, $La(CH_3COO)_3$;
$Sm(NO_3)_3$, $SmCl_3$;
$BeSO_4$, $Be(NO_3)_2$;
$SnCl_2$, $SnCl_4$, $SnSO_4$;
$ZrC;_4$, $Zr(NO_3)_2$, $Zr(SO_4)_2$;
$Mg(CH_3COO)_2$, $Mg(NO_3)_2$, $MgSO_4$;
$BaCl_2$, $Ba(CH_3COO)_2$, $Ba(NO_3)_2$, $BaSO_4$;
$NdCl_3$, $Nd(NO_3)_3$;
$CdSO_4$, $Cd(NO_3)_2$;
$VOSO_4$, $VOCl_3$;
$Ga(NO_3)_3$.

The aqueous bath with which the polymeric substrate is to be treated may further contain, if desired, one or more additives such as a pH controlling agent and a reducing agent. The pH controlling agent may be an organic acid such as acetic acid, citric acid or tartaric acid, an inorganic acid such as sulfuric acid or hydrochloric acid, and a weak base such as sodium acetate, sodium secondary phosphate, sodium bicarbonate or sodium citrate. These pH controlling agents may be used singly or in combination of two or more. The reducing agent may be sodium bisulfite, sodium sulfite, sodium hypophosphite.

The copper salt to be contained in the aqueous bath may be present in an amount of 2–30% by weight based on the weight of the polymeric substrate to be treated. The second metal salt (silver and/or palladium salt) may be present in an amount of 0.001–1.0 mole, preferably 0.01–0.7 mole, as second metal ion, per mole of the copper ion present in the bath. The third metal salt may be present in an amount of 0.05–1.0 mole, preferably 0.01–0.7 mole, as third metal ion, per mole of the copper ion. The thiosulfate may be present in the aqueous bath in an amount of 0.7–2 times the mole, preferably 0.8–1.5 times the mole, of the total mole of the first through third metal ions.

The treatment in the aqueous bath is generally performed at a temperature of 35°–80° C. for 2–8 hours.

The present electrically conducting material may also be prepared by a method including treating a polymeric substrate containing copper sulfide bound thereto with an aqueous bath containing a source of the above-described second metal ion, a source of the above-described third metal ion and thiosulfate to form sulfides of the second and third metals bound to the polymeric substrate. In this case, the second metal salt may be used in an amount of 0.1–5% by weight based on the weight of the copper sulfide-containing polymeric substrate. The third metal salt may be present in an amount of 0.1–5% by weight based on the weight of the copper sulfide-containing polymeric substrate. The thiosulfate may be used in an amount of 1–5 times the mole of the total mole of the second and third metal ions. The treatment in the aqueous bath is generally performed at a temperature of 25°–80° C., preferably 35°–65° C. for 1–2 hours.

The following examples will further illustrate the present invention. Washability was determined according to the method specified in Japanese Industrial Standard JIS L 0217–103. Thus, a sample thread is sewed in a polyester fabric and the resulting fabric is washed with water containing 2 g/liter of a commercially available detergent (NEW BEAD manufactured by Kao Co., Ltd.) using an electric washing machine. The weight ratio of the fabric to the washing water is 1:30. Washing is carried out at 40° C. for 5 minutes, followed by dehydration. This is then washed with clean water for 2 minutes and the washed fabric is dried. The above procedure consisting of washing with detergent water, dehydration, washing with water and drying is repeated a number of times. The washability of the sample thread is evaluated by measuring the electrical resistance in 1 cm length of the sample.

EXAMPLE 1

100 Parts by weight of polyacrylonitrile threads (SILPALON, manufactured by Mitsubishi Rayon Co., Ltd., 100 deniers, 40 filaments) were immersed in an aqueous bath containing 20 parts by weight of cupric sulfate, 1 part by weight of silver nitrate, 0.5 part by weight of basic bismuth sulfate, 18 parts by weight of sodium thiosulfate, 10 parts by weight of anhydrous sodium sulfite, 10 parts by weight of citric acid and 15 parts by weight of sodium secondary phosphate. The bath containing the threads was gradually heated from room temperature to 60° C. and maintained at that temperature for 3 hours. The treated threads were then washed with water and dried to obtain electrically conducting threads having a specific resistivity of $2.5\times10^{-1}$ ohm.cm.

Comparative Example 1

Example 1 was repeated in the same manner as described except that silver nitrate was not incorporated in the aqueous bath. The resulting threads had a specific resistivity of $2.2\times10^{-1}$ ohm.cm.

Comparative Example 2

Example 1 was repeated in the same manner as described except that basic bismuth sulfate was not incorporated in the aqueous bath. The resulting threads had a specific resistivity of $2.1\times10^{-1}$ ohm.cm.

The electrically conducting threads obtained in Example 1 and Comparative Examples 1 and 2 were subjected to a washability test. The electric resistance (ohm) of the threads before washing and after 20, 40, 60, 80 and 100 washes are shown in Table 1.

TABLE 1

| Threads | Number of Washes | | | | | |
|---|---|---|---|---|---|---|
| | 0 | 20 | 40 | 60 | 80 | 100 |
| Example 1 | 705 | 720 | 860 | 970 | 1060 | 1450 |
| Comptv. Ex. 1 | 630 | 13000 | ∞ | — | — | — |
| Comptv. Ex. 2 | 520 | 580 | 1300 | 6330 | 38000 | ∞ |

Example 2

Example 1 was repeated in the same manner as described except that basic bismuth sulfate was substituted by $ZnSO_4$, $In_2(SO_4)_3$, $SiCl_4$, $SbCl_5$, $A1_2(SO_4)_3$, $MnSO_4$, RbCl, LiCl, $Tl_2SO_4$, $WCl_6$, $TiCl_3$, $Cr_2(SO_4)_3$, $MoCl_5$, $Y(NO_3)_3$, $GeCl_4$, $Yb(NO_3)_3$, $La(NO_3)_3$, $Sm(NO_3)_3$, $BeSO_4$, $SnSO_4$, $Zr(SO_4)_2$, $MgSO_4$, $BaCl_2$, $Nd(NO_3)_3$, $CdSO_4$, $VOSO_4$ or $Ga(NO_3)_3$. The electrically conducting threads thus obtained were subjected to a washability test. The electric resistance (ohm) of the threads before washing and after 20, 40, 60, 80 and 100 washes are shown in Table 2 together with the results of Example 1.

TABLE 2

| Metal Used | Number of Washes | | | | | |
|---|---|---|---|---|---|---|
| | 0 | 20 | 40 | 60 | 80 | 100 |
| Bi | 705 | 720 | 860 | 970 | 1060 | 1450 |
| Zn | 1330 | 1410 | 1480 | 1620 | 2480 | 4930 |
| In | 1210 | 1230 | 1260 | 1310 | 1810 | 2350 |
| Si | 1380 | 1370 | 1380 | 1430 | 2240 | 3660 |
| Sb | 1150 | 1110 | 1340 | 1520 | 2460 | 4330 |
| Al | 1050 | 1090 | 1240 | 1720 | 2910 | 5100 |
| Mn | 1340 | 1360 | 1350 | 1380 | 2330 | 4105 |
| Rb | 1150 | 1170 | 1210 | 1810 | 2340 | 4260 |
| Li | 1450 | 1440 | 1460 | 1305 | 1850 | 2860 |
| Tl | 1360 | 1370 | 1390 | 1920 | 3860 | 7210 |
| W | 1150 | 1145 | 1170 | 1190 | 2100 | 3580 |
| Ti | 1320 | 1330 | 1390 | 1460 | 2720 | 3860 |
| Cr | 1580 | 1590 | 1600 | 1640 | 2280 | 4320 |
| Mo | 1420 | 1420 | 1480 | 1640 | 2310 | 4550 |
| Y | 1380 | 1385 | 1420 | 1540 | 2620 | 4180 |
| Ge | 2100 | 2280 | 2270 | 2350 | 2910 | 5120 |
| Yb | 1520 | 1520 | 1540 | 1590 | 2540 | 4560 |
| La | 1410 | 1420 | 1440 | 1680 | 2980 | 5240 |
| Sm | 1520 | 1535 | 1560 | 2105 | 5220 | 8210 |
| Be | 1380 | 1400 | 1420 | 1750 | 4210 | 6130 |
| Sn | 1250 | 1255 | 1270 | 1280 | 1530 | 2250 |
| Zr | 1200 | 1210 | 1305 | 1630 | 2790 | 5150 |
| Mg | 1150 | 1160 | 1180 | 1310 | 1690 | 3150 |
| Ba | 1210 | 1215 | 1220 | 1240 | 1710 | 2980 |
| Nd | 1530 | 1530 | 1540 | 1610 | 2240 | 4160 |
| Cd | 1080 | 1095 | 1090 | 1100 | 2150 | 4300 |
| V | 1270 | 1280 | 1320 | 1820 | 3150 | 5110 |
| Ga | 1730 | 1730 | 1740 | 1780 | 3090 | 6180 |

Example 3

Example 1 was repeated in the same manner as described except that 0.1 part of $PdCl_2$ was substituted for 1 part of silver nitrate. The resulting threads were found to have a specific resistivity of $2.2\times10^{-1}$ ohm.cm and to exhibit washability similar to those of Example 1.

Example 4

10 Grams of polyamide (Nylon) threads (100 deniers, 40 filaments) were washed with water containing nonionic surfactant, rinsed with water and dried. The threads were then treated with 0.5 g of mercapto group-containing silane coupling agent at 100° C. for 60 minutes. The resulting mercapto group-containing nylon threads were treated in the same manner as that in Example 1 to obtain electrically conducting threads having a specific resistivity of $3.6\times10^{-1}$ ohm.cm.

Comparative Example 3

Example 4 was repeated in the same manner as described except that basic bismuth sulfate was not incorporated in the aqueous bath. The resulting threads had a specific resistivity of $3.0\times10^{-1}$ ohm.cm.

The electrically conducting threads obtained in Example 4 and Comparative Example 3 were subjected to a washability test. The electric resistance (ohm) of the threads before washing and after 20, 40, 60, 80 and 100 washes are shown in Table 3.

TABLE 3

| Threads | Number of Washes | | | | | |
|---|---|---|---|---|---|---|
| | 0 | 20 | 40 | 60 | 80 | 100 |
| Example 4 | 1250 | 1320 | 1490 | 2460 | 8300 | 23090 |
| Comptv. Ex. 3 | 1210 | 1280 | 2060 | 11500 | 180000 | ∞ |

Example 5

10 Grams of polyacrylonitrile threads (SILPALON, manufactured by Mitsubishi Rayon Co., Ltd., 100 deniers, 40 filaments) were immersed in an aqueous bath containing 20 parts by weight of cupric sulfate, 18 parts by weight of sodium thiosulfate, 10 parts by weight of sodium bisulfite, 10 parts by weight of citric acid and 15 parts by weight of sodium secondary phosphate. The bath containing the threads was gradually heated from room temperature to 60° C. and maintained at that temperature for 3 hours. The treated threads were then washed with water and dried to obtain electrically conducting threads having a specific resistivity of $1.1\times10^{-1}$ ohm. cm. 100 Parts by weight of the thus obtained threads were immersed in an aqueous bath containing 4 parts by weight of sodium thiosulfate, 1 part by weight of silver nitrate and 0.5 part by weight of basic bismuth sulfate. The bath containing the threads was gradually heated from room temperature to 60° C. and maintained at that temperature for 1 hour. The treated threads were then washed with water and dried to obtain electrically conducting threads having a specific resistivity of $2.7\times10^{-1}$ ohm.cm. The electric resistance (ohm) of the threads before washing and after 20, 40, 60, 80 and 100 washes are shown in Table 4.

TABLE 4

| Threads | Number of Washes | | | | | |
|---|---|---|---|---|---|---|
| | 0 | 20 | 40 | 60 | 80 | 100 |
| Example 5 | 850 | 980 | 1360 | 2390 | 648 | 15100 |

What is claimed is:

1. An electrically conductive material comprising a polymeric substrate containing a group which can capture cuprous ion, a first sulfide consisting of copper sulfide, a second sulfide consisting of silver sulfide, and a third sulfide which is at least one member selected from the group consisting of sulfides of Bi, Li, Mo, La and Sm, said first, second and third sulfides being bound to said polymeric substrate, wherein the amount of said first sulfide is 0.5–30% based on the weight of said polymeric substrate, while the amounts of said second and third sulfides are such as to provide atomic ratios $M_2/Cu$ and $M_3/Cu$ in the range of 0.001–1.0, where $M_2$ and $M_3$ represent the metals of said second and third sulfides, respectively.

2. A process for the preparation of an conducting material, comprising contacting a polymeric substrate containing a group which can capture cuprous ion with an aqueous bath containing a source of first metal ion which is cuprous ion, a source of silver ion as a second metal ion, a source of third metal ion selected from the group consisting of ions of Bi, Li, Mo, La and Sm and thiosulfate to form sulfides of said first, second and third metals bound to said polymeric substrate, wherein the amount of said first sulfide is 0.5–30% based on the weight of said polymeric substrate, while the amounts of said second and third sulfides are such as to provide atomic ratios $M_2/Cu$ and $M_3/Cu$ in the range of 0.001–1.0, where $M_2$ and $M_3$ represent the metals of said second and third sulfides, respectively.

3. A process for the preparation of an electrically conducting material, comprising contacting a polymeric substrate containing sulfide of a first metal, which is copper sulfide bound to said substrate, with an aqueous bath containing a source of silver ion as a second metal ion, a source of third metal ion selected from the group consisting of ions of Bi, Li, Mo, La and Sm, and thiosulfate to form sulfides of said second and third metals bound to said polymeric substrate, wherein the amount of said first sulfide is 0.5–30% based on the weight of said polymeric substrate, while the amounts of said second and third sulfides are such as to provide an atomic ratios $M_2/Cu$ and $M_3/Cu$ in the range of 0.001–1.0, where $M_2$ and $M_3$ represent the metals of said second and third sulfides, respectively.

4. An electrically conductive material in accordance with claim 1 wherein $M_3/Cu$ is in the range of 0.001–0.1.

5. A process in accordance with claim 2 wherein $M_3/Cu$ is within the range of 0.001–0.1.

6. A process in accordance with claim 3 wherein $M_3/Cu$ is within the range of 0.001–0.1.

* * * * *